US005082007A

United States Patent [19]

Adell

[11] Patent Number: 5,082,007

[45] Date of Patent: Jan. 21, 1992

[54] MULTI-LAMINAR MOUTHGUARDS

[75] Inventor: Loren S. Adell, 200 Adell Blvd., Sunnyvale, Tex. 75182

[73] Assignees: Loren S. Adell; Michael Adell, Sunnyvale, Tex.

[21] Appl. No.: 469,286

[22] Filed: Jan. 24, 1990

[51] Int. Cl.[5] ..... A61C 5/14

[52] U.S. Cl. ..... 128/861; 128/859; 128/860; 128/862

[58] Field of Search ..... 128/859, 860, 861, 862; 272/95; 433/6, 36

[56] References Cited

U.S. PATENT DOCUMENTS

| | | | |
|---|---|---|---|
| 2,833,278 | 5/1958 | Ross | 128/862 |
| 3,385,291 | 5/1968 | Martin | 128/862 |
| 3,457,916 | 7/1969 | Wolicki | 128/862 |
| 3,532,091 | 10/1970 | Lerman | 128/861 |
| 3,692,025 | 10/1972 | Greenberg | 128/861 X |
| 3,844,286 | 10/1974 | Cowen | 128/861 X |

FOREIGN PATENT DOCUMENTS 301987 10/1989 World Int. Prop. O. ..... 433/6

*Primary Examiner*—Danton D. DeMille
*Assistant Examiner*—Kerry Owens
*Attorney, Agent, or Firm*—George L. Boller

[57] ABSTRACT

A mouthguard that possesses a number of unique features including: a two part main body in which the two parts are exactly identical so that they can be fabricated by the same mold; the main body has internal pockets that provide for the placement of a lower durometer material within the main body, particularly the molar regions; the main body is constructed in two parts to provide for the inclusion of air/saliva ducts and the attachment of a separate attaching strap; the relative thicknesses of the liner material and the main body material can be varied in particular ways at the occlusal wall; the buccal wall has pocketry containing different durometer material; a bite locator is provided; and the liner forms a significant portion of the buccal wall as a smooth rounded edge.

28 Claims, 6 Drawing Sheets

MULTI-LAMINAR MOUTHGUARDS

REFERENCE TO RELATED APPLICATIONS AND INCORPORATION THEREOF BY REFERENCE

This new patent application is related in certain aspects to my pending patent applications Ser. No. 07/176,046, filed Mar. 30, 1988 now U.S. Pat. No. 4,955,393 and Ser. No. 07/329,407, filed Mar. 27, 1989 now abandoned. The disclosures of those applications are incorporated herein by reference.

BACKGROUND AND SUMMARY OF THE INVENTION

This invention relates to mouthguards and their manufacture, and represents further improvements that I have made in connection with my continuing development work on mouthguards.

My pending patent applications that are mentioned above, include disclosures involving multi-laminar (multi-layer) construction. I have found that these improvements provide a mouthguard that can be manufactured on a production basis (as distinguished from custom-made mouthguards) and that can exhibit improved functionality when properly used by an individual. Thus, in certain respects, my inventive activity relates to improvements in mouthguards that are intended to be sold commercially, such as by sporting goods companies, mass-merchandisers and the like.

In general, the mouthguards that are disclosed in my above pending applications comprise a main body of higher durometer material which contains upper and lower troughs in which a lower durometer liner material is situated.

The present invention involves further improvements in the design and manufacture of multi-laminar mouthguards.

One aspect of my invention relates to a construction in which the main body is constructed to provide for internal zones of material that has durometer lower than that of the main body. The inclusion of these lower durometer zones offers the possibility for improved impact absorbtion, and hence, improved performance. The embodiment of such internal lower durometer zones can be accomplished in any of several unique ways.

One way is by fabricating the main body in two halves, providing one or more pockets in one or both of the two halves at locations where the two halves interface with each other, and filling the pockets with lower durometer material. The filling of the pockets with lower durometer material may be accomplished by means of injecting material into the pockets, or by placing an insert into the pockets before the two halves of the main body are placed together. The insert may be a piece of suitable material or it may be a gel-type, or even fluid, material that is encapsulated within an enclosure, such as a sac or bag.

Another aspect of the invention relates to the manner in which the two pieces of the main body are fabricated. In particular, the two halves of the main body can be fabricated as identical parts that can fit together to create the complete main body. This result is obtained in the disclosed embodiment by fabricating locating means in each part that are identical from part to part, but which in each part are complementary in a symmetrical manner in the individual part.

A related aspect of the multi-piece main body construction involves the attachment of an attaching strap when such an attaching strap is desired in the mouthguard. Suitable pocketry can be fashioned in the two halves for acceptance of an attaching end portion of an attaching strap that fits into the pocketry so that when the two halves are placed together, the attaching end portion of the attaching strap is captured between them. The portion of the strap that fits to the main body has a locating means for properly locating the strap with respect to the main body.

A still further feature of the invention relates to the shaping of the mouthguard in certain regions thereof. One improvement involves the creation of a slightly indented area in the occlusal wall of the main body in the molar regions. Another involves the use of the rim of the liner material to form a smoothly rounded rim of a trough's buccal wall; in particular the rim of the liner material forms a significant portion of the wall containing the trough rim, and its smooth rounded shape promotes wearer comfort.

Further features, advantages, and benefits of the invention will be seen in the ensuing description and claims. These are accompanied by drawings which illustrate a presently preferred embodiment of the invention, according to the best mode contemplated at the present time in carrying out the invention.

DESCRIPTION OF THE PREFERRED EMBODIMENT

Figure 1:
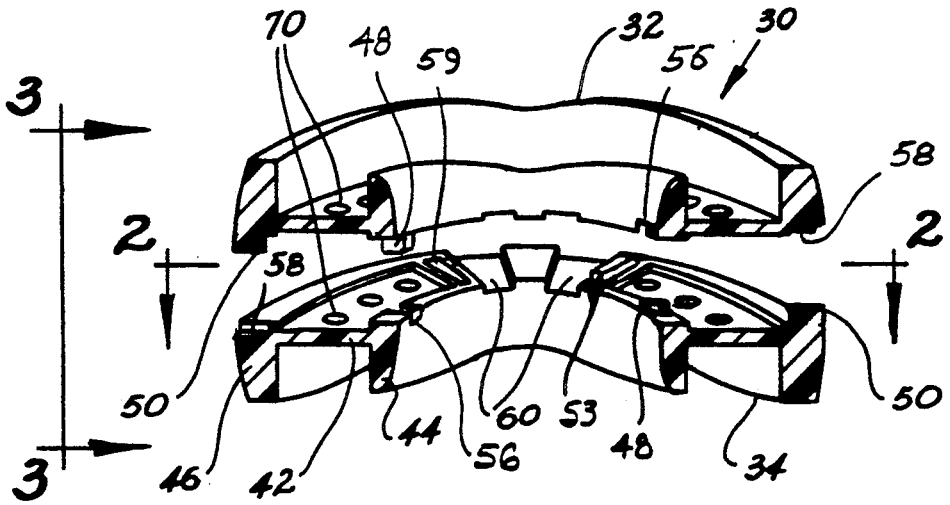
FIG. 1 is lingual perspective view taken in cross section in the direction of arrows 1—1 in FIG. 2 and relating to the fabrication of a first embodiment of mouthguard acording to the invention.
Figure 2:
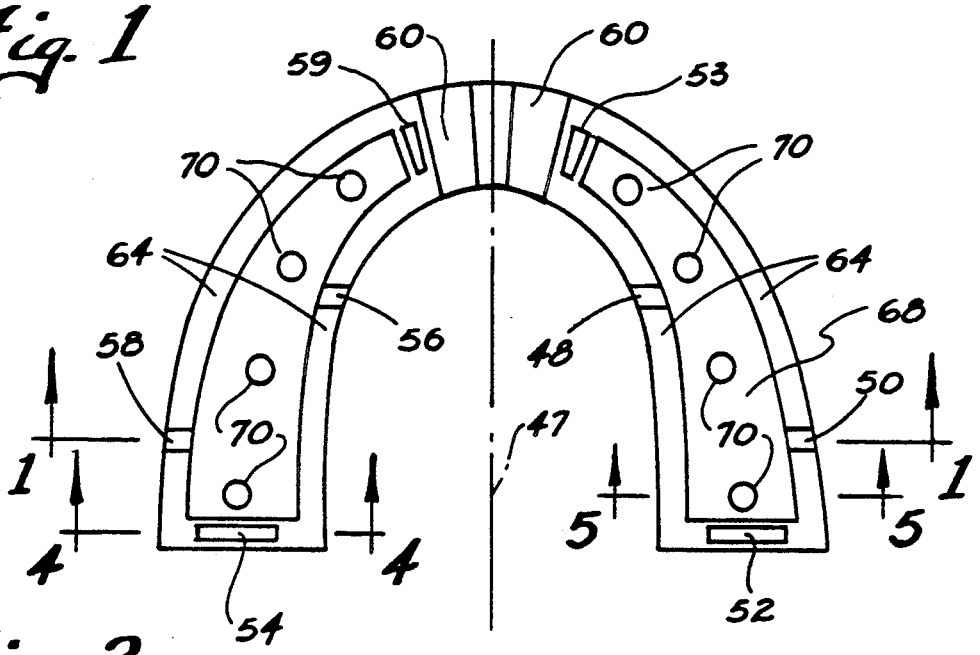
FIG. 2 is a view taken in the direction of arrows 2—2 in FIG. 1.
Figure 6:
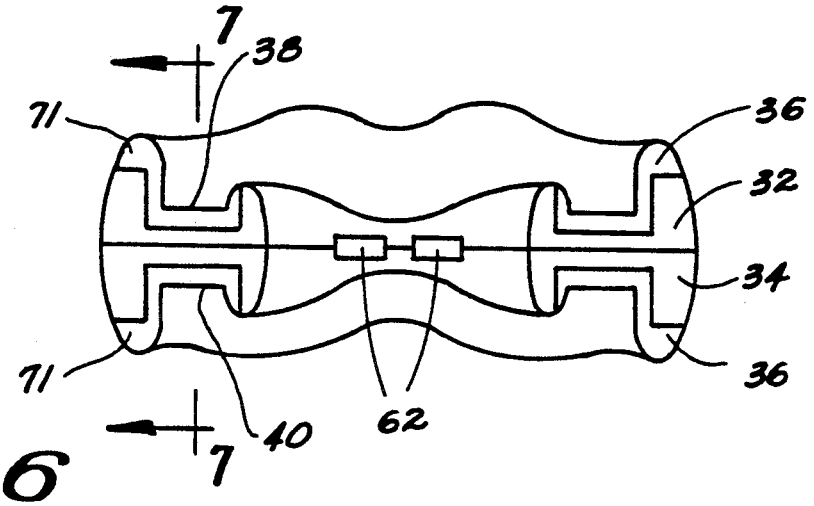
FIG. 6 is a lingual view in the same general direction as FIG. 1 showing the completed first embodiment.
Figure 3:
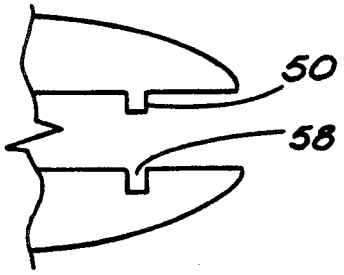
FIG. 3 is a fragmentary elevational view of a portion of FIG. 1, as taken in the direction of arrows 3—3 in FIG. 1.
Figure 4:
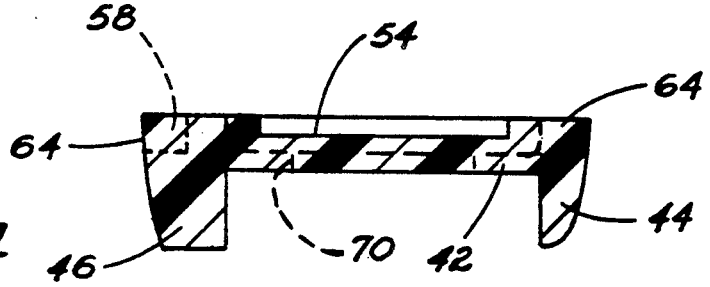
FIG. 4 is a sectional view taken in the direction of arrows 4—4 in FIG. 2.
Figure 5:
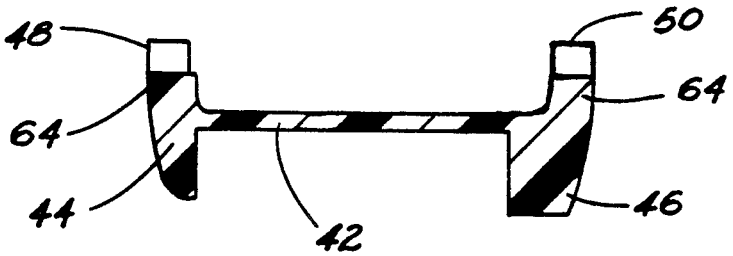
FIG. 5 is a sectional view taken in the direction of arrows 5—5 in FIG. 2.

FIGS. 1-9 relate to a first embodiment of mouthguard 30. In a general way this embodiment may be considered to comprise a three part construction consisting of a upper main body part 32, a lower main body part 34, and a liner part 36. As revealed best by FIG. 6, the completed mouthguard has an upper trough 38 for receiving teeth of the upper arch, and a lower trough 40 for receiving teeth of the lower arch. Liner part 36 lines both troughs 38, 40, with upper main body part 32 providing for the forming of the upper trough 38, and lower main body part 34 providing for the forming of the lower trough 40. Each main body part has an occlusal wall portion 42, a lingual wall portion 44, and a buccal wall portion 46. The occlusal wall portions of the two main body parts are in juxtaposed relation to conjointly form the main body occlusal wall. The two lingual wall portions 44 cooperatively form the lingual wall, and the two buccal wall portions 46, the buccal wall.

In accordance with one aspect of the invention, the two parts 32, 34 are identical, and therefore are capable of being fabricated in the same mold. The completed mouthguard is fabricated by juxtapositioning the occlusal wall portions of the two parts 32, 34 and then molding the liner part in place so as to form a unitary mass that constitutes the mouthguard.

In order to aid in the proper juxtapositioning of the two main body parts, their confronting portions are provided with integral locating means. Furthermore, these locating means are organized and arranged such that the locating means in the upper part is complementary to the locating means in the lower part, and in each individual part the locating means has a pattern that is symmetrically complementary about the medial plane 47 that bisects the mouthguard into right and left halves. Thus it can be seen in FIG. 2 that there are four connectors, or projections, 48, 50, 52, 53 in the right half of the part and four receivers, or receptacles, 54, 56, 58, 59 in its left half, and that the pattern of the connectors is the mirror image of that of the receivers about the medial bisector plane.

The confronting sides of the occlusal walls of each main body part contain lingual/buccal slots 60 that are spaced closely to each side of the medial plane so that in the completed mouthguard there are two air/saliva ducts 62 at the incisal region. Such air/saliva ducts are a feature of the disclosure of my above-referenced patent application Ser. No. 07/176,046. One of the advantages of constructing the main body in two halves is that a less complex, and less expensive, mold is required for creating the air/saliva ducts.

Beyond these ducts 62, the construction further comprises walled regions 64. When the two parts 32, 34 are placed together in juxtaposition, the connectors of each lodge in the receivers of the other, and the edges of the walled regions of one part abut those of the other part. This forms two pockets 66, 68 mesially beyond the air/saliva ducts.

Each part 32, 34 also contains several holes 70 that extend completely through its occlusal wall portion within its walled regions 64. When the two parts are placed in juxtaposition in the manner described in the immediately preceding paragraph, these holes 70 provide communication to the pockets 66, 68. It is at this stage of the fabrication process that the liner part is fabricated onto the mated main body parts 32, 34. The process involves placement of the mated main body parts into a suitably shaped mold cavity, and then injecting the material that is to form the liner into the cavity. The liner material, while fluid, can be injected through holes 70 to enter and fill pockets 66, 68 while also forming the lining of the troughs. The completed form is presented by FIGS. 6-9.

The material of the main body parts 32, 34 is preferably a higher durometer, and therefore, harder material than that of the liner part. For example, about a forty durometer liner and about an eighty-five durometer main body are suitable. EVA is suitable for the material of both the main body and liner. The finished construction of the mouthguard comprises the liner part serving to interlock with the two juxtaposed main body parts so that the three parts are an integral unit, and the liner part integrates the liner material lining the troughs, the material passing through the holes 70 and the material filling pockets 66, 68.

Figure 7:
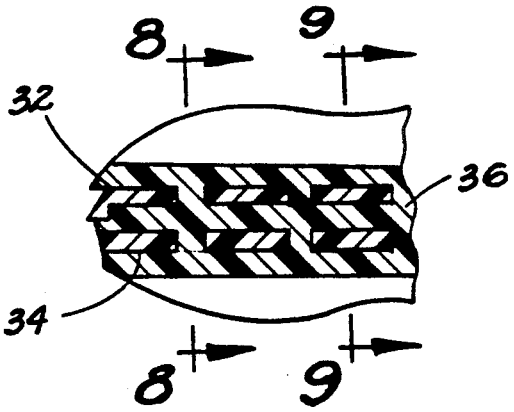
FIG. 7 is a fragmentary sectional view taken in the direction of arrows 7—7 in FIG. 6.
Figure 8:
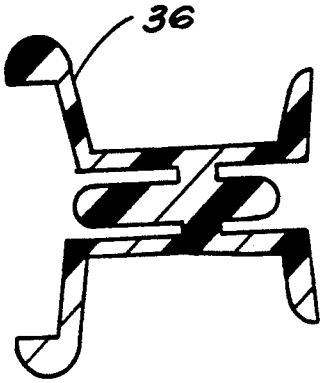
FIG. 8 is a sectional view taken in the direction of arrows 8—8 in FIG. 7, but with the main body being omitted.
Figure 9:
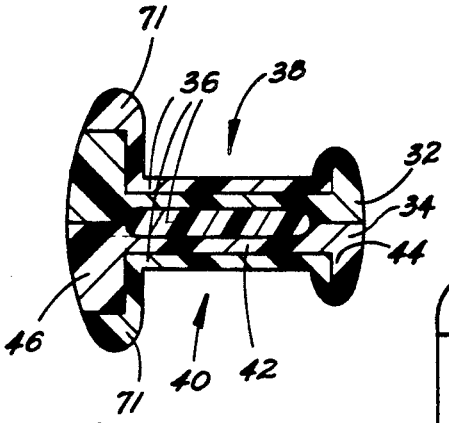
FIG. 9 is a sectional view taken in the direction of arrows 9—9 in FIG. 7.

From a functional standpoint when the mouthguard is in use, the liner material filling the pockets can aid in impact force absorption and dissipation. The effect of the filled pockets is to create a five layer construction for the occlusal wall along the pocket regions, as can be seen in FIG. 7. The finished mouthguard also possesses the feature of having the liner material form smooth rounded edges 71 extending along the buccal walls for promoting wearer comfort. (See FIG. 21 also.) Not only do edges 71 have a smooth rounded shape, they also form a structural part of each trough's buccal wall, about one-fourth to one-third of the height of that wall. This constitutes a further inventive feature.

Figure 10:
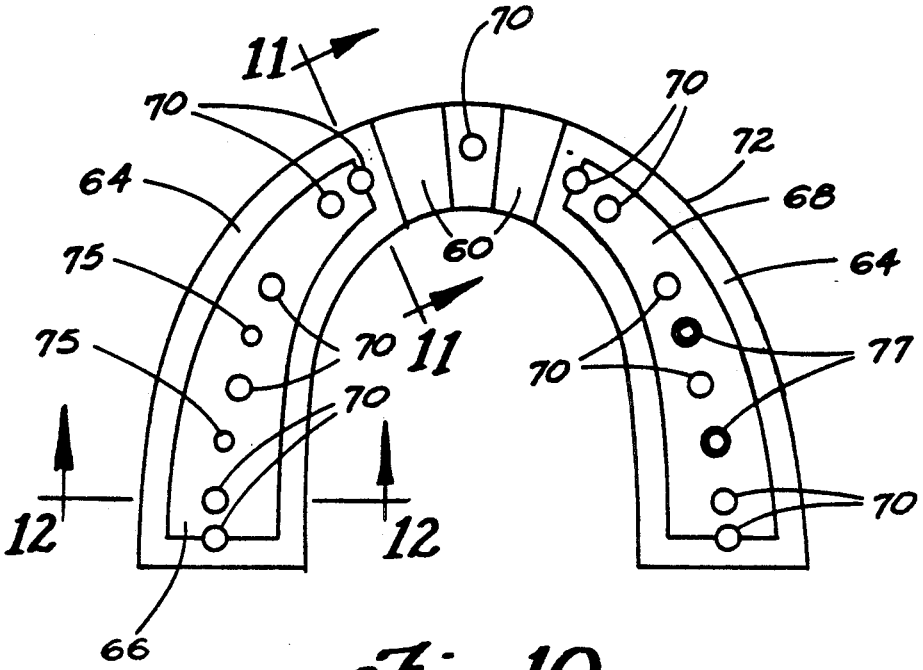
FIG. 10 is a view in the same direction as the view of FIG. 2, but relating to a second embodiment.
Figure 11:
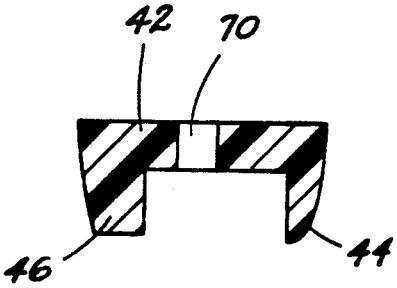
FIG. 11 is a sectional view taken in the direction of arrows 11—11 in FIG. 10.
Figure 12:
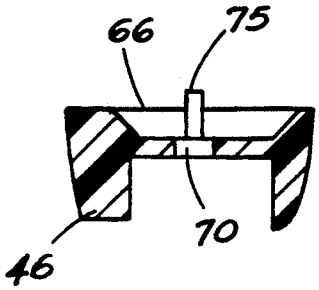
FIG. 12 is a sectional view taken in the direction of arrows 12—12 in FIG. 10.

FIGS. 10-12 portray a second embodiment of mouthguard 72 which is generally similar to the first embodiment 30. Accordingly, like reference numerals will be used to designate like features of both embodiments, as well as for ensuing embodiments. The chief difference between the two embodiments 72 and 30 is in the pattern of connectors and receivers and of holes 70. The connectors are in the form of circular male dowels 75 while the receivers are in the form of circular female dowels 77. The dowels are of suitable lengths such that they mate in telescopic fashion when the two main body parts are juxtaposed. The pattern of holes 70 comprises a total of six holes associated with each pocket. The first and sixth holes of each pocket partially intersect the shorter sides of the generally four-sided pocket wall. Fabrication of mouthguard 72 is accomplished in the same manner as for the first embodiment 30. The result is a five-layer occlusal wall within the pocket regions. It is possible to make the male dowels of tubular shape so that during molding of the liner onto the main body, liner material can pass through the telescoped dowels to provide additional integral joining of the portions of the liner material that are disposed in the troughs. FIG. 10 shows a ridge of essentially the same height as walled regions 64 located between the two slots 60 to comprise a hole 70 so that the two halves of the main body can be integrally united by liner material at the region between the two air/saliva ducts 62.

Figure 13:
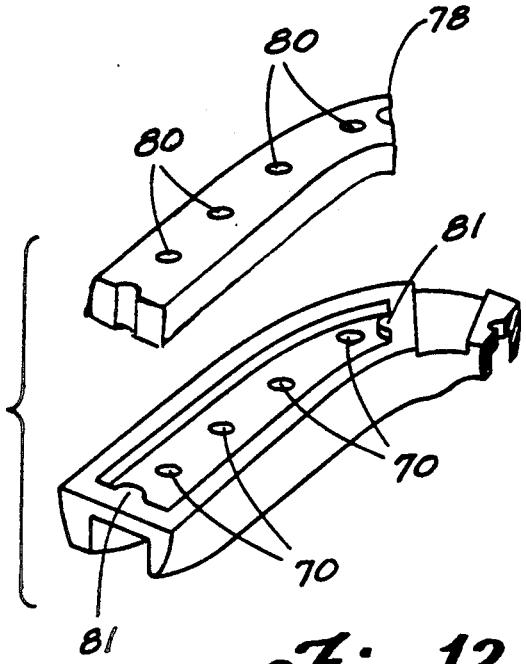
FIG. 13 is a fragmentary perspective view relating to a third embodiment.

FIG. 13 presents a construction that differs in the manner in which the pockets are filled. In this construction, a suitably shaped pre-pack 78 is disposed between each of the two pairs of confronting pocket regions prior to the juxtapositioning of the two main body parts 32, 34. The pre-pack 78 has a suitable durometer that may be the same as, or different from that of the liner part 36. The pre-pack contains through-holes 80 that align with the holes 70 so that when the liner part is fabricated onto the pre-pack-containing main body parts, the liner material can pass through the holes 70 and 80 to integrally join the upper trough liner with the lower trough linear. The final result is that the pre-packs are captured within the pockets, and a five layer construction results along the pocket regions. If the durometer of the pre-packs differs from both that of the linear and that of the main body parts, the five-layer construction will feature 1) two outer layers of the same relatively softer durometer (i.e. linear material) overlying 2) two layers of the same relatively harder durometer (i.e. main body material) overlying 3) a single layer (i.e. pre-pack material) of a durometer that differs from those of the other four layers. Of course the pre-pack layer could be of a durometer that is the same as that of the liner material. The embodiment of FIG. 13 comprises pins 81 integrally formed at the pockets end walls, and the ends of the pre-pack contain suitable accommodations for these pins. Alternatively, these pins could be holes 70 as in FIG. 10 to provide for linear material to pass through during the molding of the linear onto the main body.

Figure 14:
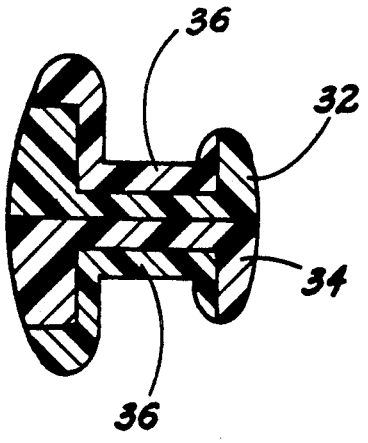
FIG. 14 is a sectional view relating to a multi-laminar configuration.

FIG. 14 represents an embodiment that omits the pockets so that a multi-layer, or multi-laminar, construction results.

Figure 15:
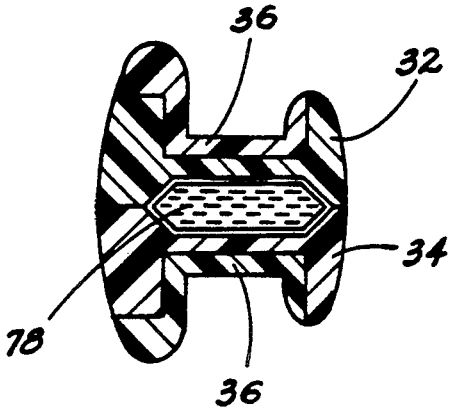
FIG. 15 is a sectional view relating to another multi-laminar configuration.

FIG. 15 represents an embodiment in which the pre-pack is in the form of a membrane-encapsulated fluid (air or liquid) or a gel.

Figure 16:
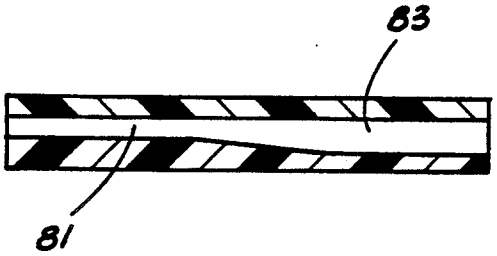
FIG. 16 is a fragmentary sectional view of a modification.

FIG. 16 illustrates a further feature that may be incorporated into a two-part main body, but which will result in the two-parts no longer being identical. This feature involves constructing the two parts of the main body such that the occlusal wall of the main body has a reduced thickness along its mesial regions 81 (i.e. for the molars) in comparison to its thickness labially of these regions at 83. The overall thickness of the complete occlusal wall of the mouthguard is generally the same throughout so that this construction results in greater total thickness for the linear material in the labial region than in the molar regions. A desirable embodiment of this construction is represented by FIG. 16 which shows that the main body occlusal wall has it, lower surface indented in the molar regions. This can produce a somewhat different characteristics for the finished mouthguard than if the wall had uniform thickness throughout.

Figure 17:
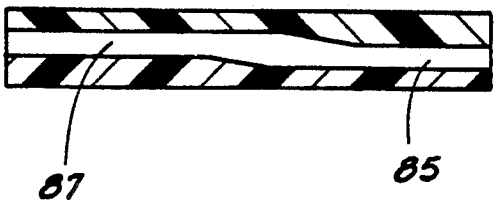
FIG. 17 is a fragmentary sectional view of another modification.

A further aspect of this feature is shown by FIG. 17 where the thickness of the occlusal wall of the main body is also reduced along the labial region 85 by making an indentation in the upper surface of the main body along the labial region. This can also produce a different characteristic, and as illustrated in FIG. 17, may be combined with a decreased thickness occlusal wall of the lower main body part along the mesial molar regions 87. Constructions such as those of FIGS. 16 and 17 may provide for the creation of better impressions when the mouthguard is put to use by an individual.

Figure 19:
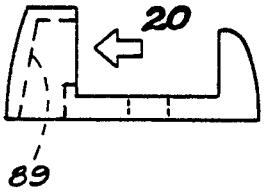
FIG. 19 is a sectional view taken in the direction of arrows 19—19 in FIG. 18.
Figure 20:
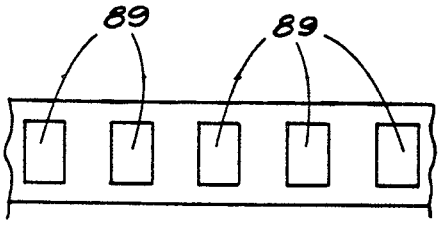
FIG. 20 is a fragmentary view looking in the direction of arrow 20 in FIG. 19.
Figure 18:
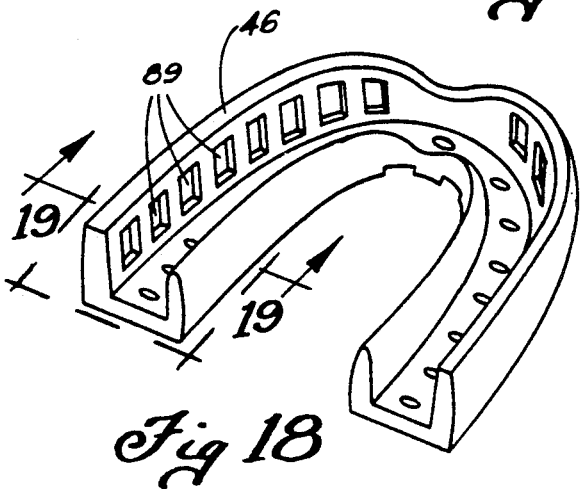
FIG. 18 is a perspective view relating to yet another embodiment.

FIGS. 18–20 present a further feature that may be incorporated into one or both halves of the main body. It comprises the inclusion of pockets 89 into the buccal wall. When the two halves of the main body are assembled for receiving the linear material, the linear material will flow into pockets 89 so that two different durometer materials will be present in the buccal wall of the mouthguard. By so including these buccal wall pockets filled with liner material, the compressive characteristic of the mouthguard along the buccal wall may be made different from that which would exist in a solid buccal wall mouthguard of only main body material. The pockets are created by suitably designing the mold that is used to fabricate the main body halves. The pockets are open at both the inside of the buccal wall and the occlusal wall, and can be created during molding by use of suitable projections in the mold cavity.

Figure 23:
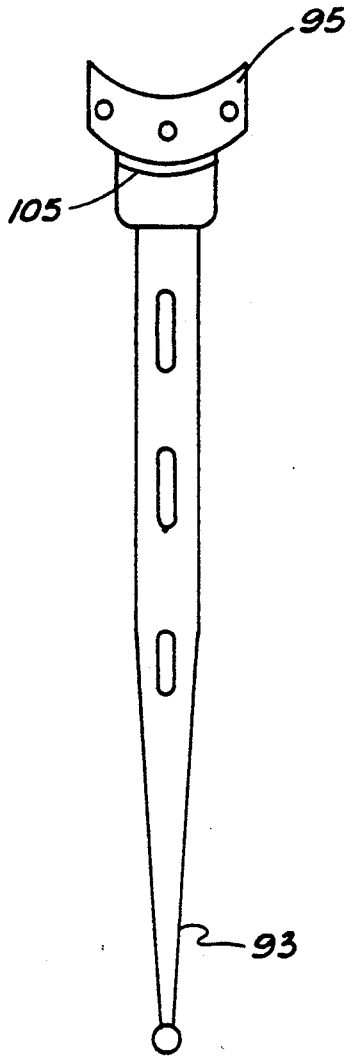
FIG. 23 is a view of an attaching strap for use with a mouthguard.
Figure 24:
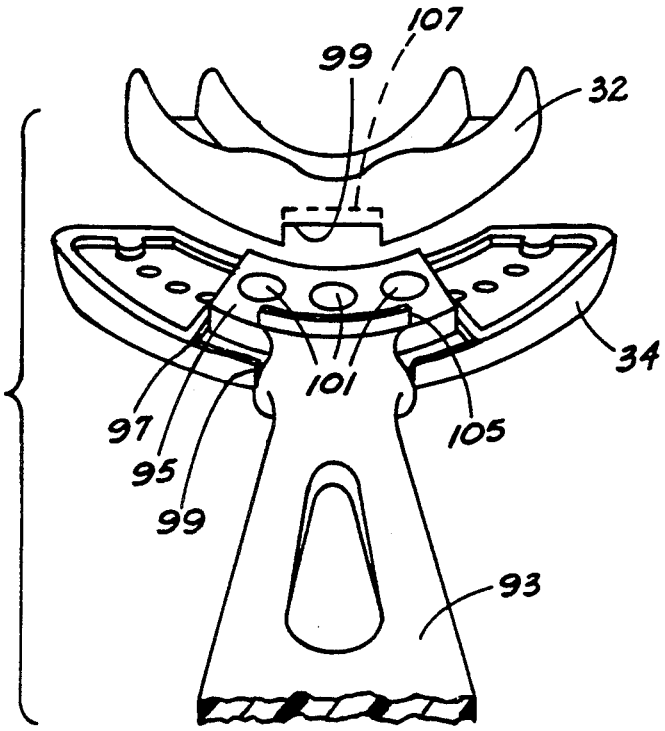
FIG. 24 is a view illustrating the manner of attaching the attaching strap to a mouthguard.
Figure 25:
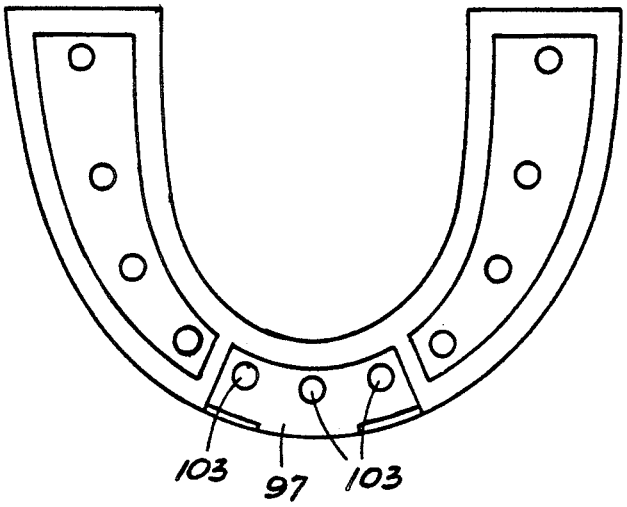
FIG. 25 is a plan view of the bottom half of the main body of FIG. 24.

FIGS. 23–25 illustrate an embodiment that includes an attaching strap 93, such as is often used in a mouthguard to provide attachment to a helmet's face mask or face bar. The attaching strap is molded as a separate piece (FIG. 23), and the the two main body parts 32, 34 are designed for accommodation of the strap. The strap is fabricated of a suitable material, EVA, for example, and preferably has a durometer equal to or slightly less than that of the main body material. The end of the strap that joins with the main body of the mouthguard comprises an arcuately shaped portion 95 that is adapted to fit between opposing pocket portions 97 that are designed into the labial region of the two main body halves. The buccal walls of the two main body parts contain suitable notches 99 that provide for passage of the strap through the buccal wall of the finished main body. As shown by the drawing, it is possible to include holes 101 in the arcuately shaped portion that align with corresponding holes 103 in the occlusal wall portions of the two main body halves, so that when the liner part is molded onto the two main body parts after the strap has been captured between the two halves, linear material will pass through the aligned holes to integrally join the liner material in one trough with the liner material in the other trough. The attaching strap also has a tab 105 that is situated to fit behind the buccal wall of the upper main body half, in the area indicated in broken lines 107 in the drawing.

Figure 22:
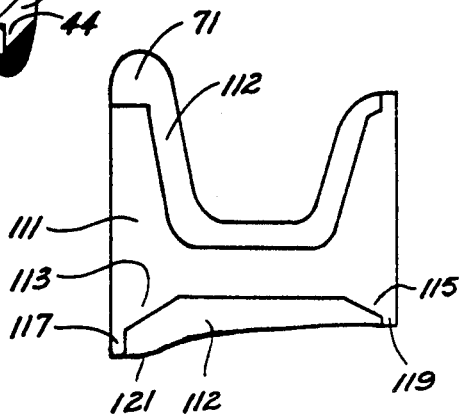
FIG. 22 is a view in the direction of arrow 22 in FIG. 21.
Figure 21:
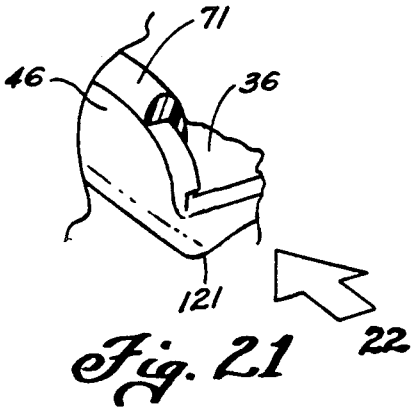
FIG. 21 is a fragmentary perspective view partly in cross section.

FIGS. 21 and 22 present an embodiment that incorporates the smooth rounded edge 71 for the upper edge of the upper trough's buccal wall in accordance with principles described earlier. The embodiment of these two FIGS. differs from earlier embodiments in that it comprises a one-piece main body 111 having the upper trough noticeably deeper than the lower trough. Linear material 112 lines the occlusal wall of the main body in both troughs; it also lines the lingual and buccal walls of the upper trough. For the lower trough however, the shallow nature of the trough essentially precludes any liner covering its lingual and buccal walls. In fact, the lingual and buccal walls of the lower trough are in the form of small ridges of triangular-shaped cross section, as best seen in FIG. 22. The numeral 113 designates the somewhat larger buccal ridge and the numeral 115 the somewhat smaller lingual ridge. Each ridge also has a lip 117, 119 respectively, and the lower trough liner material abuts the interior side of each lip, as seen in FIG. 22. At its abutment with the lip 117, the liner is somewhat rounded (121). This construction, particularly along the buccal ridge, forms a bite locator for the impression of the lower arch. In other words it aids in centering the mouthguard when the person places it in his or her mouth for impressioning. This feature is therefore quite useful.

As appears in the drawing Figs., the joint lines between the upper and lower main body halves are exposed in the completed mouthguards. If desired, the liner material could be molded around the walls to cover either one or both of these joint lines at any desired location or locations along the joint lines.

The present invention has therefore been shown to comprise a number of features representing improvements in mouthguards. While a presently preferred embodiment of the invention has been disclosed, it should be appreciated that principles are applicable to other equivalent embodiments within the scope of the following claims.

I claim:

1. A mouthguard comprising a main body having two individual parts, in which one of said two parts forms an upper trough portion and the other of said two parts forms a lower trough portion, and liner material of a lower durometer than the durometer of said two main body parts lines both troughs and also integrally joins the liner material lining said upper trough portion with the liner material lining said lower trough portion such that the liner material interlocks said two main body parts in juxtaposition to create an integral mouthguard unit wherein said one main body part juxtaposedly overlies said other main body part.

2. A mouthguard as set forth in claim 1 in which each of said parts has a respective occlusal wall portion, the upper trough portion liner material is integrally joined with the lower trough portion liner material by linear material passing through at least one pair of aligned throughholes in said respective occlusal wall portions of the two main body parts.

3. A mouthguard as set forth in claim 2 in which the two main body parts cooperatively define internal pocketry that contains a material of different durometer from that of the main body parts.

4. A mouthguard as set forth in claim 3 in which the material within said pocketry contains at least one throughhole aligning with at least one pair of the aligned throughholes in the occlusal wall portions and liner material that integrally joins the upper trough portion liner material with the lower trough portion liner material passes through said at least one throughhole of the material within said pocketry.

5. A mouthguard as set forth in claim 3 in which the material within said pocketry comprises liner material.

6. A mouthguard as set forth in claim 3 in which the material within said pocketry comprises a membrane whose shape conforms generally to that of the pocketry, said membrane containing a gel- or fluid-type material.

7. A mouthguard as set forth in claim 1 in which the two main body parts are identical.

8. A mouthguard as set forth in claim 7 in which each main body part has a respective occlusal wall portion and contains locating means in its respective occlusal wall portion to facilitate juxtapositioning with the other part in assembly relationship.

9. A mouthguard as set forth in claim 8 in which said locating means comprises in each part a pattern of connectors lying to one side of a medial plane bisecting each part and a pattern of receivers lying to the other side of the medial plane that is the mirror image about the medial plane of its pattern of connectors.

10. A mouthguard as set forth in claim 9 in which each of the two main body parts comprises a walled region forming a pocket such that with the two parts of the main body in assembly relationship, pocketry is cooperatively formed between the two parts.

11. A mouthguard as set forth in claim 10 in which at least some of said connectors and receivers are located in the wall portion of the walled regions.

12. A mouthguard as set forth in claim 10 in which at least some of said connectors and receivers are located interiorly of the wall portion of the walled regions.

13. A mouthguard as set forth in claim 10 in which a material of a different durometer from that of the two main body parts is disposed in said pocketry.

14. A mouthguard as set forth in claim 13 in which the material disposed in said pocketry is liner material.

15. A mouthguard as set forth in claim 13 in which the material disposed within said pocketry is an separate part that is placed between the two main body parts before the latter are placed in assembly relationship.

16. A mouthguard as set forth in claim 10 in which said pocketry is in the form of two pockets at each molar region.

17. A mouthguard as set forth in claim 1 in which air/saliva ducts are cooperatively formed by the two main body parts when the latter are in assembly relationship.

18. A mouthguard as set forth in claim 1 in which at least one of said parts' trough portion has a buccal wall and liner material forms from about one-fourth to one-third of the height of said buccal wall as a smooth rounded edge.

19. A mouthguard as set forth in claim 1 in which pocketry is formed in the buccal wall of at least one of the two main body parts and liner material occupies such pocketry.

20. A mouthguard as set forth in claim 1 in which said mouthguard has a labial region and said two main body parts cooperatively define pocketry at said labial region, and including an attaching strap having one end captured in said pocketry.

21. A mouthguard comprising two individual main body parts each of which forms a corresponding one of upper and lower troughs of the mouthguard, said two main body parts being juxtaposed in assembly relationship such that the particular main body part forming the upper trough overlies the particular main body part forming the lower trough, and a unitary piece of material acting to hold said main body parts in assembly relationship wherein the particular main body part forming the upper trough juxtaposedly overlies the particular main body part forming the lower trough, said unitary piece of material having a first fractional portion thereof disposed in at least a portion of said upper trough, a second fractional portion thereof disposed in at least a portion of said lower trough, and a third fractional portion thereof extending integrally between said first fractional portion and said second fractional portion.

22. A mouthguard as set forth in claim 21 in which said main body parts comprise identical locating pattern means that aid in the juxtaposition of the two main body parts at assembly.

23. A mouthguard as set forth in claim 22 in which said two main body parts comprise walled pocket portions that cooperatively form internal pocketry when the two main body parts are in assembly, such pocketry containing material of different durometer from that of the two main body parts.

24. A mouthguard comprising a main body having internal pocketry at a labial region thereof and means defining an aperture extending from a labial exterior surface portion of the main body through the main body to said pocketry, including an attaching strap for the mouthguard, said attaching strap being a separate part having one end captured in said main body pocketry and extending from said one end through said aperture.

25. A mouthguard comprising at least one trough for an arch, said trough comprising an occlusal wall and a buccal wall, said mouthguard comprising a main body forming a portion of said at least one trough including a portion of said occlusal wall and a portion of said buccal wall, said mouthguard comprising liner material lining at least a portion of said portion of said at least one trough formed by said main body including lining said portion of said occlusal wall and lining said portion of said buccal wall, said liner material also extending away from said occlusal wall beyond said portion of said buccal wall formed by said main body to form about one-fourth to one-third of the height of said buccal wall as a smooth rounded edge that is disposed beyond said buccal wall portion formed by said main body.

26. A mouthguard comprising a main body having an occlusal wall covered by liner material on both sides, the sum of the thicknesses of the occlusal wall and the liner material covering both sides of the occlusal wall in total being generally uniform over at least a portion of the mouthguard, said occlusal wall and said liner material having relative thicknesses such that in at least a portion of said mouthguard portion, the thickness of the liner material covering one side of the occlusal wall is greater than that of the liner material covering the other side of the occlusal wall, such greater thickness being caused by non-uniformity of said occlusal wall of said main body in said at least a portion of said mouthguard portion.

27. A mouthguard as set forth in claim 26 in which the lower thickness of the liner material is greater than the upper thickness of the liner material along a molar region of the mouthguard.

28. A mouthguard adapted for insertion into a user's mouth to receive an impression of the user's upper and lower arches when so inserted and bitten on by the user, said mouthguard comprising an upper trough for the upper arch, a lower trough for the lower arch, occlusal wall means between said troughs, said lower trough being shallower than said upper trough, said lower trough comprising a buccal wall and a lingual wall both extending away from said occlusal wall means, but with said lingual wall being shorter than said buccal wall, said buccal wall in transverse view comprising a triangle integrally adjoining with said occlusal wall means and a lip integrally adjoining with and extending from a vertex of the triangle that is spaced from said occlusal wall means, said lingual wall in transverse view comprising another triangle integrally adjoining with said occlusal wall means and another lip integrally adjoining with and extending from a vertex of said another triangle that is spaced from said occlusal wall means, and tooth-impressionable liner material filling said lower trough to the level of said lips to present an exterior surface into which the teeth of the lower arch are adapted to be impressed, and said exterior surface of said liner material being rounded immediately adjacent said lip of said buccal wall and then extending generally straight across said lower trough to said lip of said lingual wall, that rounded portion of said exterior surface of said liner material that is immediately adjacent said buccal wall being disposed in underlying relation to a surface of said triangle of said buccal wall that extends obliquely from said lip of said buccal wall.

* * * * *